US006734777B2

(12) United States Patent
Yeh et al.

(10) Patent No.: US 6,734,777 B2
(45) Date of Patent: May 11, 2004

(54) TRANSFORMER WITH IMPROVED INSULATION

(75) Inventors: Ming Yeh, Taipei Hsien (TW); Heng-Cheng Chou, Taipei Hsien (TW); Chen-Feng Wu, Taoyuan Hsien (TW); Ren-Jye Huang, Taoyuan Hsien (TW)

(73) Assignee: Delta Electronics Inc. (TW)

( * ) Notice: Subject to any disclaimer, the term of this patent is extended or adjusted under 35 U.S.C. 154(b) by 21 days.

(21) Appl. No.: 10/097,348

(22) Filed: Mar. 15, 2002

(65) Prior Publication Data

US 2002/0145497 A1 Oct. 10, 2002

(30) Foreign Application Priority Data

Apr. 4, 2001 (TW) ..... 90205207 U

(51) Int. Cl.[7] ..... H01F 27/30

(52) U.S. Cl. ..... 336/208; 336/205; 336/198

(58) Field of Search ..... 336/198, 208, 336/206, 192, 83, 212, 233

(56) References Cited

U.S. PATENT DOCUMENTS

| | | | | | |
|---|---|---|---|---|---|
| 4,510,478 | A | * | 4/1985 | Finkbeiner | 336/198 |
| 4,916,424 | A | * | 4/1990 | Kijima | 336/160 |
| 6,078,240 | A | * | 6/2000 | Huang | 336/90 |
| 6,344,786 | B1 | * | 2/2002 | Chin | 336/198 |

* cited by examiner

*Primary Examiner*—Anh Mai
(74) *Attorney, Agent, or Firm*—Birch, Stewart, Kolasch & Birch, LLP

(57) ABSTRACT

A transformer with good insulation is disclosed. The transformer includes a bobbin, an insulating shell and a core structure. The bobbin is wound with a secondary winding. The insulating shell encloses the bobbin and the insulating shell is wound with a primary winding. Further, the core structure is magnetically coupled to the primary winding and the secondary winding.

12 Claims, 4 Drawing Sheets

TRANSFORMER WITH IMPROVED INSULATION

BACKGROUND OF THE INVENTION

1. Field of the Invention

The present invention relates to a transformer, and more particularly to a transformer with good insulation.

2. Description of the Related Art

Generally, because the secondary side of a transformer has a high voltage, it is generally necessary to insulate the secondary winding to prevent the electric elements or users from being harmed by high voltage. However, there are many shortcomings to several conventional method of insulating the secondary winding.

A conventional transformer, as shown in FIG. 1*a*, is composed of a bobbin 10*a*, a core structure and an insulating shell 30. The core structure comprises two E type cores 50 which are coupled together by being inserted into the two ends of the bobbin 10*a* respectively. The bobbin has a primary side 20*a* and a secondary side 20*b*. The primary side 20*a* is provided with a primary winding (not shown) and the secondary side 20*b* is provided with a secondary winding (not shown). The primary side 20*a* is separated from the secondary side 20*b* by a first separating flange 25. In addition, the primary winding is electrically coupled to at least one of the primary pins 21, and the second winding is electrically coupled to at least one of the secondary pins 22. The secondary side 20*b* further comprises a plurality of secondary flanges 27 for producing several dividing voltages. Namely, the primary winding and the secondary winding are formed along the same axis of one bobbin. Moreover, the transformer further comprises an insulating shell 30 to insulate the secondary winding from outside. The insulating shell 30 encloses the whole bobbin 10*a*.

However, in the conventional transformer shown in FIG. 1*a*, because only the first flange 25 is used to insulate the secondary winding from the primary winding, the primary winding is not completely insulated from the secondary winding. The creepage distance between the primary winding and the secondary winding may be not enough when the primary winding and the secondary winding are formed at the primary side 20*a* and the secondary side respectively, due to poor design or error in the production process, for example, the first flange 25 is too low or the secondary winding is wound too thick. In this case, the high voltage at the secondary winding may be short-circuited to the primary winding, thereby decreasing the efficiency of the transformer.

Another conventional method is to insulate the secondary winding by using an insulating glue. In FIG. 1*b*, a conventional transformer with an insulating glue is comprised of a bobbin 10*b*, a core structure and a container 60. The core structure comprises two E type cores 50 which are coupled together by being inserted into the two ends of the bobbin 10*a* respectively. The bobbin 100 has a primary side 20*a* and a secondary side 20*b*. The primary side 20*a* is provided with a primary winding (not shown) and the secondary side 20*b* is provided with a secondary winding (not shown). The primary side 20*a* is separated from the secondary side 20*b* by a first separating flange 25. In addition, the primary winding is electrically coupled to a least one of the primary pins 21, and the second winding is electrically coupled to a least one of the secondary pins 22. The secondary side 20*b* further comprises a plurality of second flanges 27 to produce several dividing voltages. Namely, the primary winding and the secondary winding are along the same axis direction of one bobbin. The transformer further comprises a container 60 to hold the secondary winding from the environment. The container 60 is used to include the bobbin 10*b* and the core structure. The insulating glue is added into the container 60 to insulate the secondary winding from environment.

However, the transformer shown in FIG. 1*b* not only has the problem about creepage distance, but it is also difficult to implement the transformer in the Surface Mount Device (SMD) type. Instead, the transformer must be implemented in stitch type because the bobbin 10*b* must be placed in the container 60. However, it is very difficult to control the potting height to cover the bobbin 10*b* but still expose the pins 21 and 22 because the pins 21 and 22 in the transformer of the SMD type and the lower surface of the bobbin 100 are almost in the same plane. Furthermore, the insulating glue must be added in a vacuum environment to prevent bubbles from being formed when the insulating glue is added into the container 60.

In view of this, it is desirable to develop a novel transformer to solve the problems mentioned above.

SUMMARY OF THE INVENTION

An object of the present invention is to provide a transformer wherein the high voltage side (secondary side) is insulated completely. The transformer of the present invention comprises a bobbin, an insulating shell and a core structure. The surface of the bobbin is provided with a plurality of flanges, a plurality of secondary side pins and secondary winding. The flanges are formed on the surface of the bobbin to form a plurality of slots on the surface of the bobbin. A conductive wire is wound on those slots to form the secondary winding. The secondary winding is electrically coupled to the pins.

The insulating shell is comprised of an upper insulating cover and a lower insulating cover, wherein the upper insulating cover covers the top surface of the bobbin and the lower insulating cover covers the bottom surface of the bobbin. Namely, the secondary winding and surface thereof are enclosed by the upper insulating cover and the lower insulating cover. Consequently, the secondary winding of the bobbin is completely electrical insulated from the environment. Moreover, another conductive wire is wound on the insulating shell to server as the primary winding and electrically coupled to the primary pins.

The upper insulating cover further comprises a top extending board, and the lower insulating cover further comprises a bottom extending board. The top extending board and the bottom extending board extend beyond the secondary pins. Alternatively, the top extending board and the bottom extending board enclose the secondary pins exactly.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE PREFERRED EMBODIMENT

The present invention provides a transformer wherein the high voltage side (secondary side) is completely insulated.

Figure 1A:
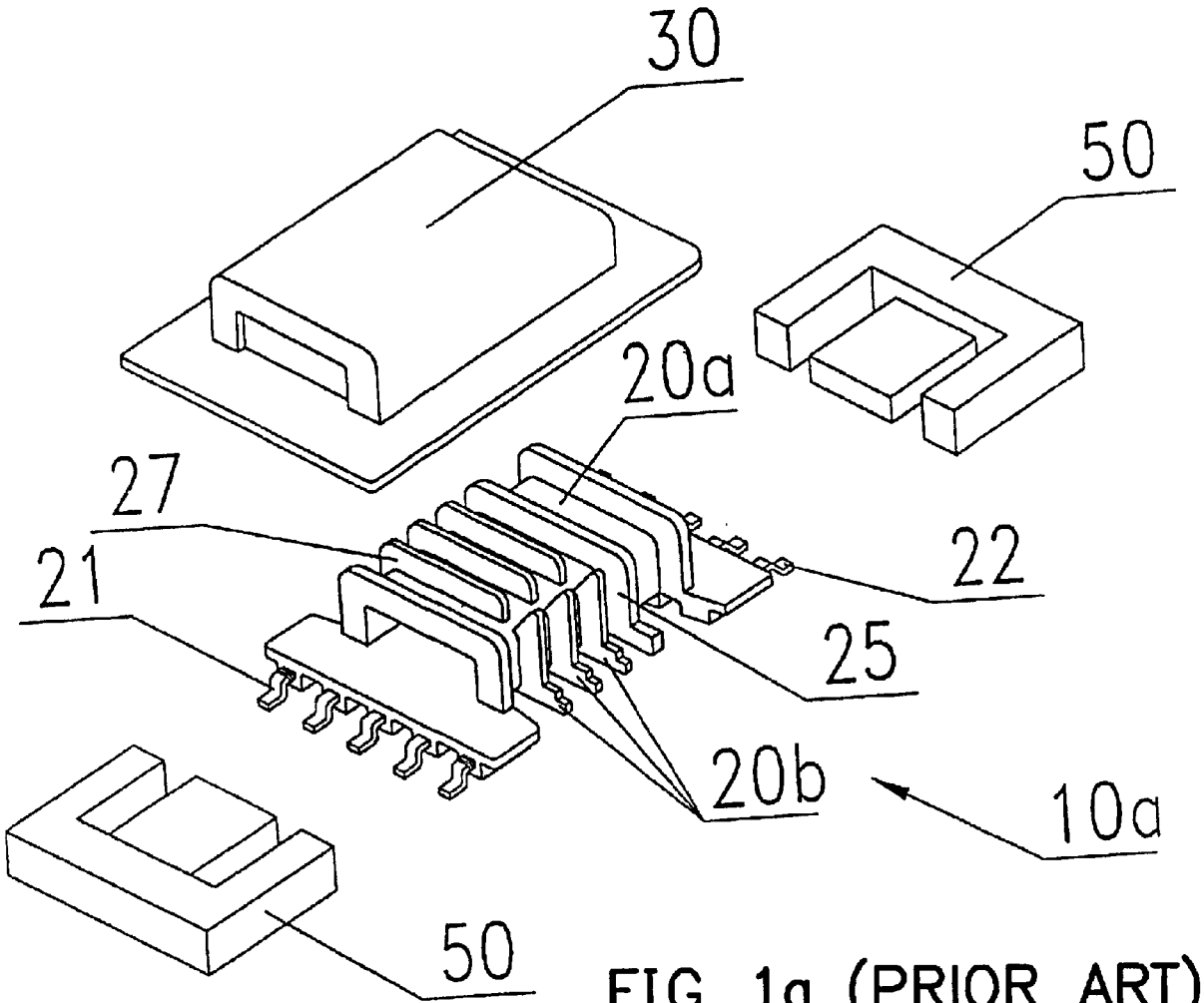
FIG. 1a (PRIOR ART)
FIG. 1*a* depicts a conventional transformer.
Figure 1B:
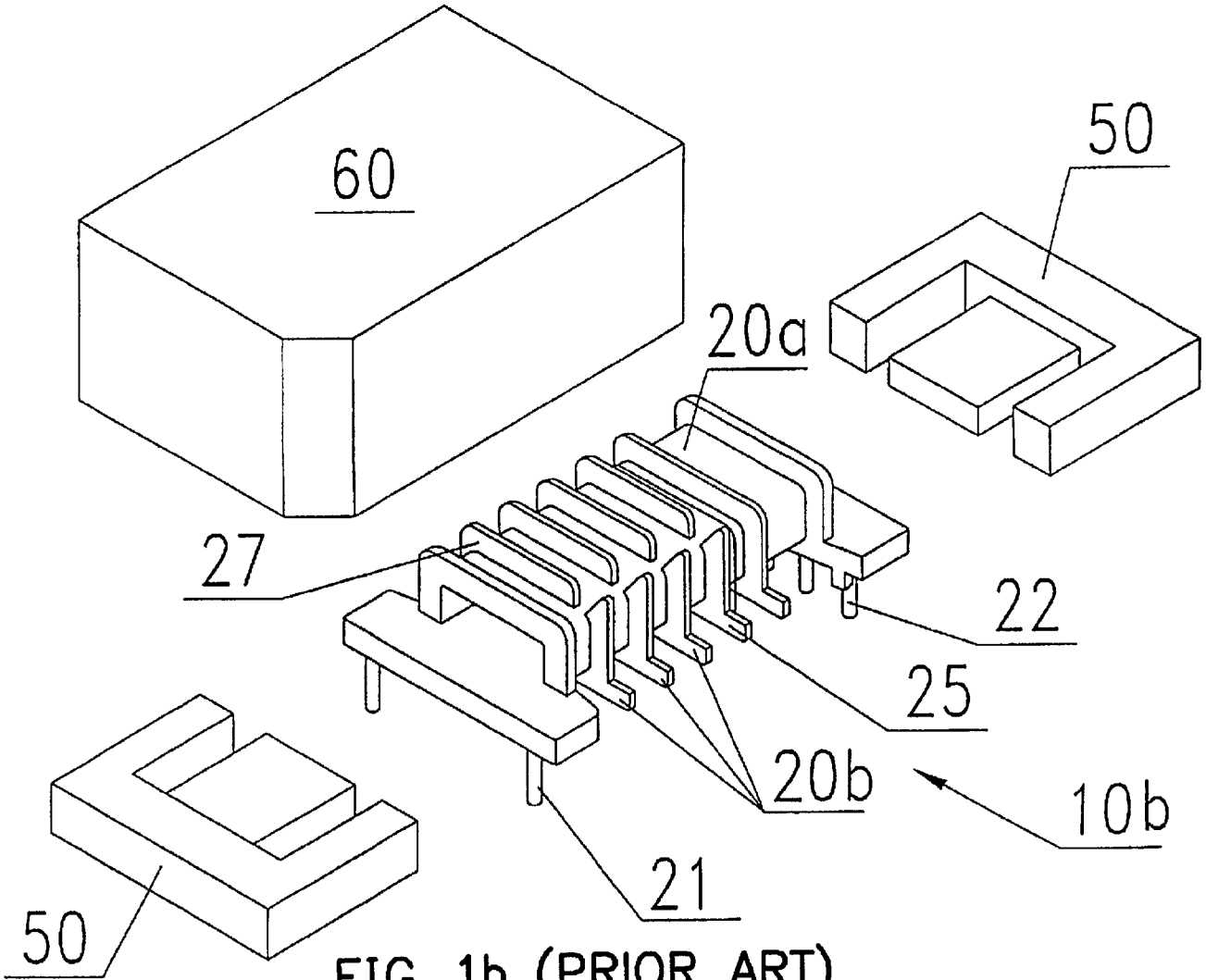
FIG. 1b (PRIOR ART)
FIG. 1*b* depicts another conventional transformer.
Figure 2A:
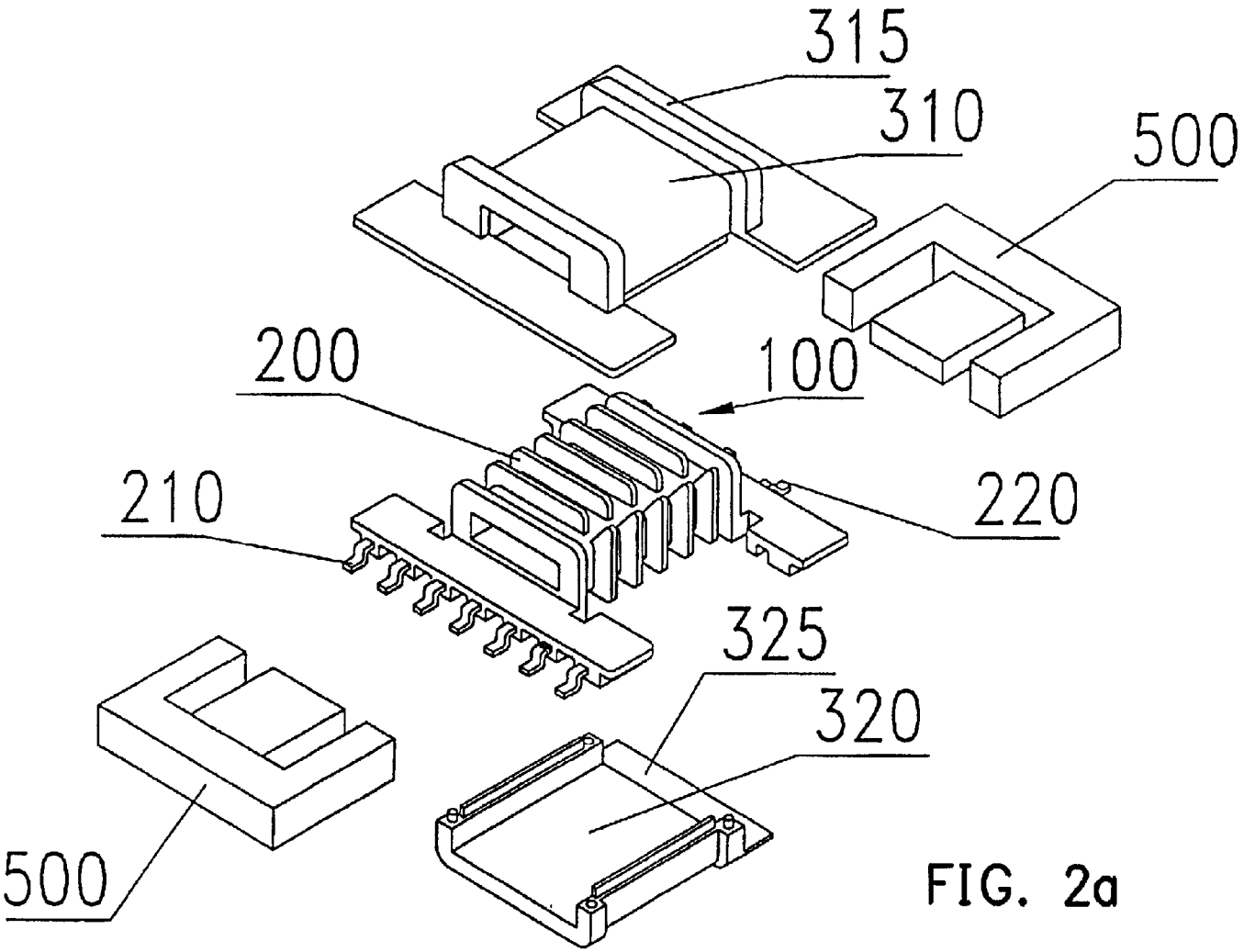
FIG. 2*a* is an exploded view illustrating the transformer according to the present invention.
Figure 2B:
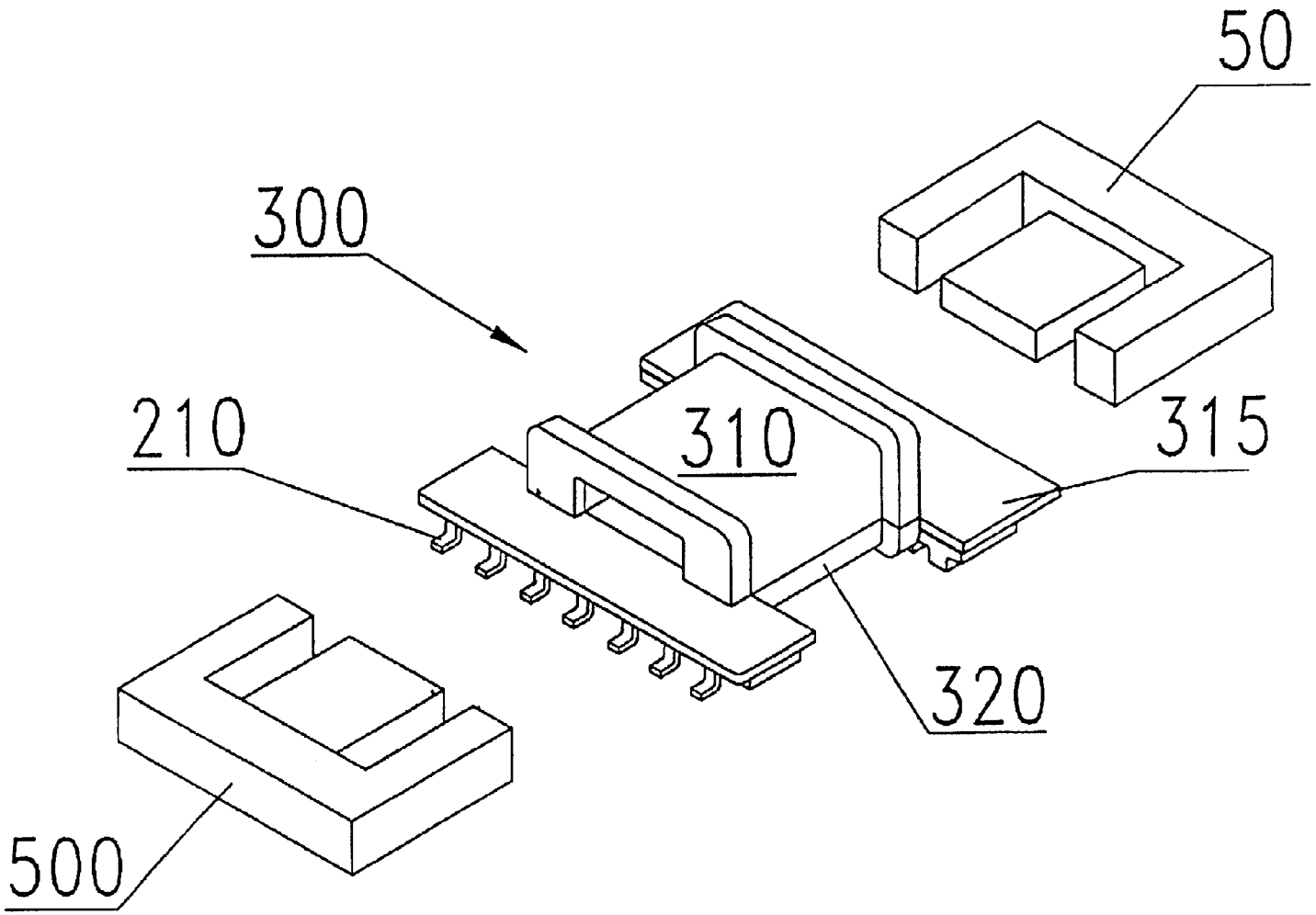
FIG. 2*b* illustrates the insulating shell of the present invention.

In FIG. 2*a* and FIG. 2*b*, the transformer of the present invention is comprised of a bobbin 100, an insulating shell 300 and a core structure. The core structure is comprised of two E type cores 500 which are coupled together by being inserted into the two ends of the bobbin 100, respectively. The surface of the bobbin 100 is provided with a plurality of flanges 200, a plurality of primary pins 210, a plurality of secondary pins 220 and a secondary winding (not shown). The plurality of flanges 200 is formed on the surface of the bobbin 100 to form a plurality of winding slots on the surface of the bobbin 100. A conductive wire or coil is wound around winding slots to form the secondary winding. Further, the secondary winding is electrically coupled to the secondary pins 220.

The insulating shell 300 is comprised of an upper insulating cover 310 and a lower cover 320. The upper insulating cover 310 encloses the top surface of the bobbin 100 and the lower insulating cover 320 encloses the bottom surface of the bobbin 100. Namely, the upper insulating cover 310 and lower insulating cover 320 enclose the bobbin 100 and the surface thereof. Accordingly, the secondary winding on the bobbin 100 is electrically insulated from environment completely. Furthermore, another conductive wire or coil is wound over the surface of the insulating shell 300 to serve as the primary winding. The primary winding is electrically coupled to the primary pins 210 of the bobbin 100. That is, in the transformer of the present invention, the insulating shell 300 which the conductive wire is wound around serves as a bobbin of the primary winding. Accordingly, the primary winding can be insulated from the secondary winding completely. Moreover, the core structure is magnetically coupled to the primary winding and the secondary winding.

The upper insulating cover 310 further comprises a top extending board 315, while the lower insulating cover 320 further comprises a bottom extending board 325. The top extending board 315 and the bottom extending board 325 may extend beyond the secondary pins 220. Alternatively, the top extending board 315 and the bottom extending board 325 may enclose the secondary pins 220 exactly. The primary winding and the secondary winding are wound around the bobbin and the insulating shell, respectively.

The present invention can separate the primary winding and the secondary winding completely, regardless of the creepage distance. Further, the manufacturing cost and process time of the present invention is greatly decreased because the present invention doesn't rely on the complex process like the use of insulating glue to insulate the primary winding from the secondary winding in the prior art.

Finally, while the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A transformer, comprising:

a bobbin having a secondary winding;

an insulating shell enclosing the bobbin, a surface of the insulating shell being wound with a primary winding; and a core structure magnetically coupled to the primary winding and the secondary winding.

2. The transformer as claimed in claim 1, wherein the insulating shell comprises:

an upper insulating cover and a lower insulating cover.

3. The transformer as claimed in claim 1, wherein the bobbin further has a plurality of primary pins and a plurality of secondary pins and the primary winding is electrically coupled to at least one of the primary pins and the secondary winding is electrically coupled to at least one of the secondary pins.

4. The transformer as claimed in claim 1, wherein the upper insulating cover further comprises an upper extending board.

5. The transformer as claimed in claim 1, wherein the lower insulating cover further comprises a bottom extending board.

6. The transformer as claimed in claim 1, wherein the bobbin further has a plurality of winding slots.

7. A transformer, comprising:

a bobbin;

a secondary winding wound around the bobbin;

an insulating shell having an upper insulating cover and a bottom insulating cover, the insulating shell enclosing the bobbin, wherein a surface of the insulating shell is wound with a primary winding; and a core structure magnetically coupled to the primary winding and the secondary winding.

8. The transformer as claimed in claim 7, wherein the bobbin further has a plurality of primary pins and a plurality of secondary pins and the primary winding is electrically coupled to at least one of the primary pins and the secondary winding is electrically couple to at least one of the secondary pins.

9. The transformer as claimed in claim 7, wherein the lower insulating cover further comprises a bottom extending board.

10. The transformer as claimed in claim 7, wherein the upper insulating cover further comprises an upper extending board.

11. The transformer as claimed in claim 7, wherein the bobbin further comprises a plurality of flanges.

12. The transformer as claimed in claim 7, wherein the core structure is comprised of two E type cores.

* * * * *